US006209335B1

(12) United States Patent
Nowaczyk

(10) Patent No.: US 6,209,335 B1
(45) Date of Patent: Apr. 3, 2001

(54) ENVIRONMENTAL DISTRIBUTION CONTROL MODULE

(75) Inventor: David J Nowaczyk, Carol Stream, IL (US)

(73) Assignee: David Nowaczyle, Carol Stream, IL (US)

( * ) Notice: Subject to any disclaimer, the term of this patent is extended or adjusted under 35 U.S.C. 154(b) by 0 days.

(21) Appl. No.: 09/368,938

(22) Filed: Aug. 5, 1999

(51) Int. Cl.[7] ..... F25B 1/00
(52) U.S. Cl. ..... 62/229; 236/49.3; 454/231
(58) Field of Search ..... 236/49.3; 454/231; 62/229

(56) References Cited

U.S. PATENT DOCUMENTS 3,563,460 * 2/1971 Nine ..... 236/49
4,915,294 * 4/1990 Wylie ..... 236/49.3
4,950,871 * 8/1990 Pollak et al. ..... 219/370
4,993,629 * 2/1991 Wylie ..... 236/11
5,497,632 * 3/1996 Robinson ..... 62/180
5,582,233 * 12/1996 Noto ..... 165/247
5,755,378 * 5/1998 Dage et al. ..... 236/91

* cited by examiner

*Primary Examiner*—Corrine McDermott
*Assistant Examiner*—Marc Norman

(57) ABSTRACT

Enhanced controls added to conventional heating and air conditioning equipment provides a uniform comfort environment though out the structure. Enhanced control module monitors variously placed sensors within the structure and activates a conventional fan. The fan mixes air throughout the structure maintaining a uniform comfort though out economically.

2 Claims, 1 Drawing Sheet

ENVIRONMENTAL DISTRIBUTION CONTROL MODULE

FIELD OF THE INVENTION

This invention relates to the heating ventilating and air condition controls of residential homes, in particular to provide a uniform comfort throughout the home utilizing conventional equipment without extensive or costly modification.

SUMMARY OF INVENTION

The environmental distribution control module invention maintains an acceptably uniform comfort throughout a residential home in an economically fashion. Current residential controls sense the environment at one location. Sun location and intensity with outside temperature heat the residential home in varying degree and location. Inconsistent heating yields various temperatures within the home. The hot second floor in two story homes demonstrates a common problem. Multiply sensing of temperature and or humidity relays information to a central module. The central module determines the heating or cooling mode and acceptable tolerance of environmental variation. The central module may contain the common functions as the standard thermostat combined with multiple sensing. The decision of heating, cooling, humidifying, and mixing activates common elements of burner, compressor, humidifier, and blower fan. Automatically controlling the fan independent of the other function allows mixing of the air to maintain a reasonably uniform environment. Utilizing the fan only when required saves energy. Minimum additional equipment and rework balanced against energy savings yields an economic advantage.

DETAILED DESCRIPTION OF INVENTION

Figure 1:
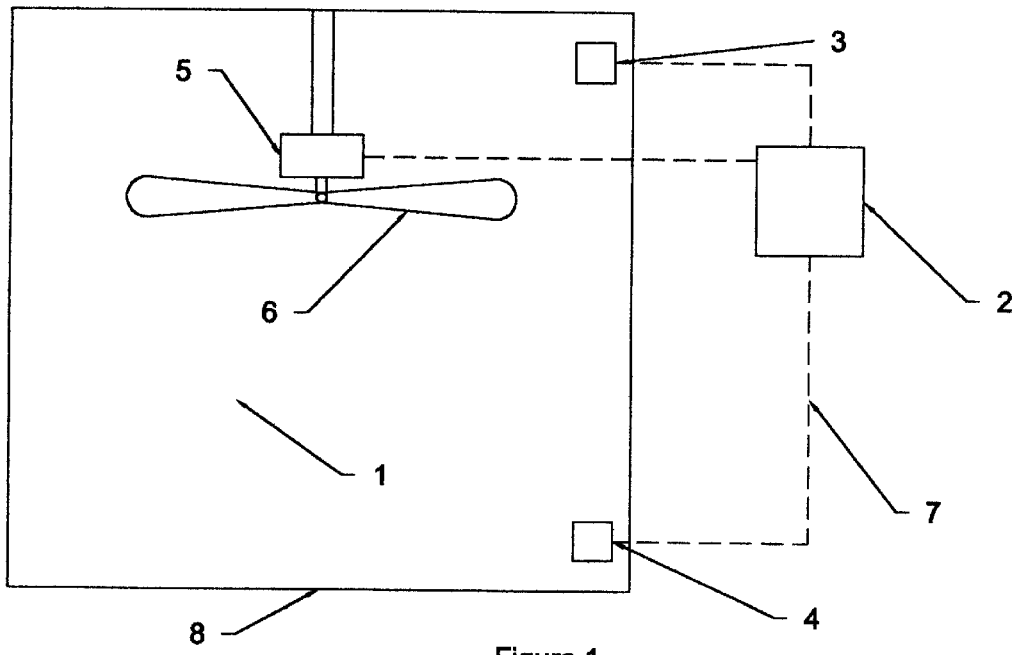
FIG. 1 Physical Layout And Control Routing

FIG. 1 relates the basic elements of this invention. Structure 8 contains a media 1 typically air. Sensors 3 and 4 located within a media at various locations determine conditions as example temperature and or humidity for air. Control module 2 compare conditions from a collection of sensors. Dashed line 7 illustrates signal and control routing. Difference comparison measure against preset limits activates an output signal on excessive deviation. Output signal initiates mixing of media 1 by running motor 5 to turn fan 6 causing mixing flow to occur. When media becomes acceptably homogenous, the control module 2 turns the motor 5 off discontinuing the media mixing. A single unit contained within housing of motor fan can sense local temperature and distance condition via as example infra red detection of remote object.

Figure 2:
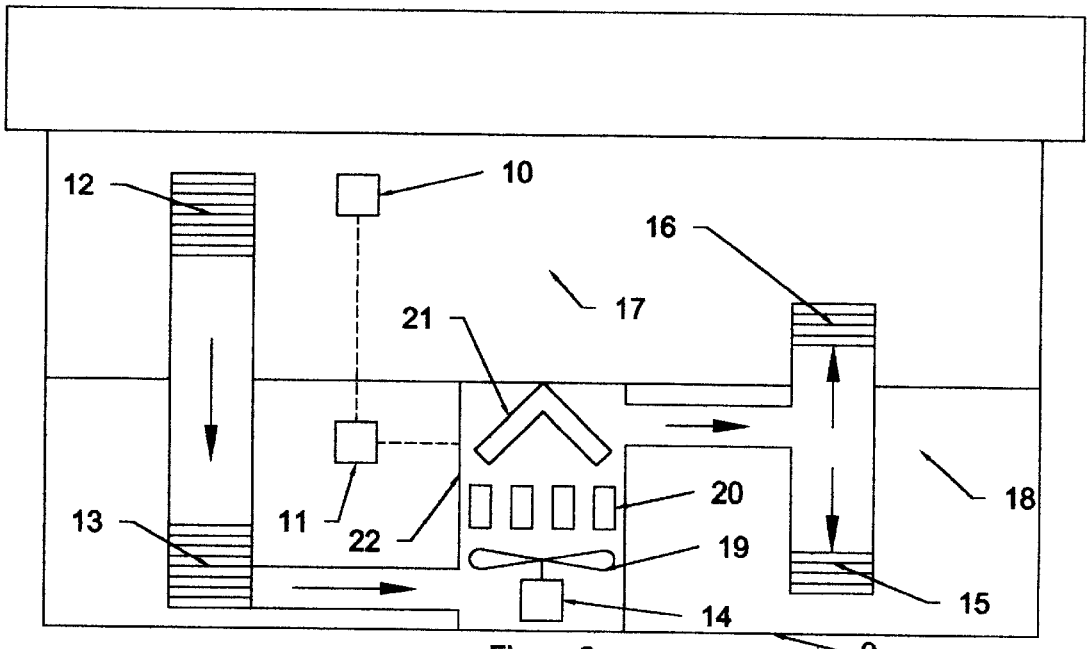
FIG. 2 Physical Layout Of Typical Two Story Home

FIG. 2 illustrates a typical household installation of this invention. A common two story home 9 contains a second floor media 17 and a first floor media 18. Sensor 10 measures temperature and or humidity of second floor media or air 17. Sensor 11 measures temperature and or humidity of first for air 18. Sensor 11 may contain additional functions of a common household thermostat. Common function list contain programmable temperature set points, humidity set points, heating or cooling mode, and manual fan run switch. Detection of compressor activation initiates an enable timer. The timer enables automatic fan operation until the time limit expires. This timer disables winter cold fan run condition. Excessive comparison difference of sensor 10 and 11 sends a to mix signal to central furnace 22. Central furnace 22 activates motor 14 to turn fan 19 when receiving a to mix signal. Air 17 from second floor enters return vent 12 and combines with air 18 from first floor entering return vent 13. Central furnace fan 18 moves the combined air through heating elements 20 and cooling elements 21. Preset conditions determine the addition or removal of heat requirements. Supply vents 15 returns air to the first floor 18 and supply vent 16 returns air to second floor 17. When sensors 10 and 11 measure sufficiently uniform conditions the to mix signal terminates run of motor 14 and hence mixing stops.

What is claimed is:

1. A control system for heating or cooling an environment, the system comprising a control module which interfaces multiple sensing of a media at various locations for comparing to a settable difference limit; determines set conditions by monitoring a last function and time for heating or cooling the environment utilizing commercially available thermostats; and, when excessive differences in temperature exist during cooling or heating mode, activates a blower fan mixing sensed media until uniformity of sensed conditions exist.

2. The control system of claim 1, further comprising placement of wire routing in a return air duct for the purpose of sensing a media condition in a given room.

* * * * *